US005184495A

United States Patent [19]

Chunn et al.

[11] Patent Number: 5,184,495

[45] Date of Patent: Feb. 9, 1993

[54] METHOD OF INTERNALLY AND EXTERNALLY UPSETTING THE END OF A METAL TUBE

[75] Inventors: William G. Chunn, Willis; Ralph T. Moore, Houston, both of Tex.

[73] Assignee: Prideco, Inc., Houston, Tex.

[21] Appl. No.: 801,969

[22] Filed: Dec. 3, 1991

[51] Int. Cl.[5] ..... B21D 41/02

[52] U.S. Cl. ..... 72/318; 72/359; 72/370

[58] Field of Search ..... 72/318, 356, 357, 354.6, 72/355.2, 359, 370

[56] References Cited

U.S. PATENT DOCUMENTS 4,845,972 7/1987 Takeuchi ..... 72/306

FOREIGN PATENT DOCUMENTS 532919 9/1931 Fed. Rep. of Germany ..... 72/359
2812803 9/1979 Fed. Rep. of Germany ..... 72/356
84633 5/1983 Japan ..... 72/370
151136 6/1991 Japan ..... 72/318

*Primary Examiner*—Daniel C. Crane
*Attorney, Agent, or Firm*—Vaden, Eickenroht, Thompson, Boulware & Feather

[57] ABSTRACT

A method is disclosed of externally and internally upsetting the end of a steel tube to provide a thicker wall for welding to a tool joint and for providing an internal tapered section having a projected length (Miu) along the longitudinal axis of the tube that substantially exceeds today's API standard upset. The method includes three upsetting steps, one pressing step, and one reheating step after the first two steps of the method.

3 Claims, 6 Drawing Sheets

METHOD OF INTERNALLY AND EXTERNALLY UPSETTING THE END OF A METAL TUBE

This invention relates to a method of internally and externally upsetting the ends of a metal tube to which tool joints are to be welded to form a joint of drill pipe.

One reason the ends of the metal tube are upset is to provide a thicker wall for welding to the tool joint and thereby provide a stronger connection between the tool joint and the tube. The end of the tube can be externally upset, internally upset, or both externally and internally upset depending upon the tool joint to be attached. Today most drill pipe tubes are both internally and externally upset to obtain the thickest possible wall for welding to the tool joint.

The American Petroleum Institute (API) sets standards for the upsets on all sizes of drill pipe and the approximate shape required by API for 5" drill pipe, where the tube is both internally and externally upset, is shown in FIG. 3. FIG. 5 is a graph plotting drill pipe failures and where on the joint they occurred. Most failures occurred between 15" to 25" from the end of the box and between about 10" to 20" from the end of the pin. It is generally agreed in the industry that the failures occur at this point because of the change in section between the upset portion of the tube and the nominal wall of the tube. In other words, it is the relatively large change in the thickness of the pipe through the short transition section A of FIG. 3 which causes high stress concentrations in the area marked "B".

Consequently there has been an effort to upset the end of the drill pipe tube in such a way as to lengthen the internal conical transition section between the relatively thick internal cylindrical section and the nominal tube wall. The length of this transition section measured along the longitudinal axis of the tube is called "Miu".

In Japanese patent publication SHO61(1986)-46212, a method of internally and externally upsetting the end of a tube is described. It involves three steps. In the first step, the tube is externally upset to have a cylindrical section with a thickened wall that is connected to the tube by a conically shaped section.

In the second step, the externally upset material from the first step is forced inwardly until the outside diameter of the tube is returned to its original diameter. The upset metal from the first step that is moved inwardly forms a thick cylindrical internal section connected to the tube by a conical section. In the third step, the end is externally upset so that the end is both internally and externally upset with conical sections connecting the internal and external cylindrical sections of the upset to the tube.

A modification of the 46212 process is described in U.S. Pat. No. 4,845,972 that issued July 11, 1989 and is assigned to Nippon Steel Corporation of Japan. The '972 patent discusses the 46212 publication and shows two figures of that publication as prior art. These are FIGS. 1B and 1C. The '972 patent says that the method of the 46212 publication makes it difficult to control the shape of the internal upset portion that is not restrained by the mandrel and that underfilling and buckling are apt to occur at that portion. Underfill and buckling would make the method of upsetting undesirable and impractical. The '972 patent goes on to say that the forging method disclosed therein ('972) is superior to the 46212 forging process because in the former "the metal of said pipe is displaced inwardly for thickening after shaping by external upset forging whereas in the 46212 disclosure all of the metal displaced in the external upset operation or step is returned inwardly so that in the final step the outside shape of the upset must be formed by again moving metal outwardly.

It is an object of this invention to provide a method of internally and externally upsetting the end of a tube to provide a thick wall for welding to a tool joint and to provide a long conical section (Miu) that has a radius of curvature at the intersection of the conical section and the inner wall of the tube of about 15" or greater.

It is a further object of this invention to provide a method of internally and externally upsetting the metal tube to provide a thick end wall for welding to a tool joint that has a substantially longer Miu dimension than has been heretofore obtainable. As stated above, the Miu dimension is the projected length of the internal conical section connecting the internal upset cylindrical section to the unupset portion of the pipe measured along the center line of the pipe.

These and other objects, advantages, and features of this invention will be apparent to those skilled in the art from a consideration of this specification including the attached drawings and appended claims.

In the drawings:

FIGS. 1A-F show the steps of the upsetting process disclosed in U.S. Pat. No. 4,845,972.

FIGS. 2A-D, show the four forging steps used in the method of this invention.

Figure 5A:
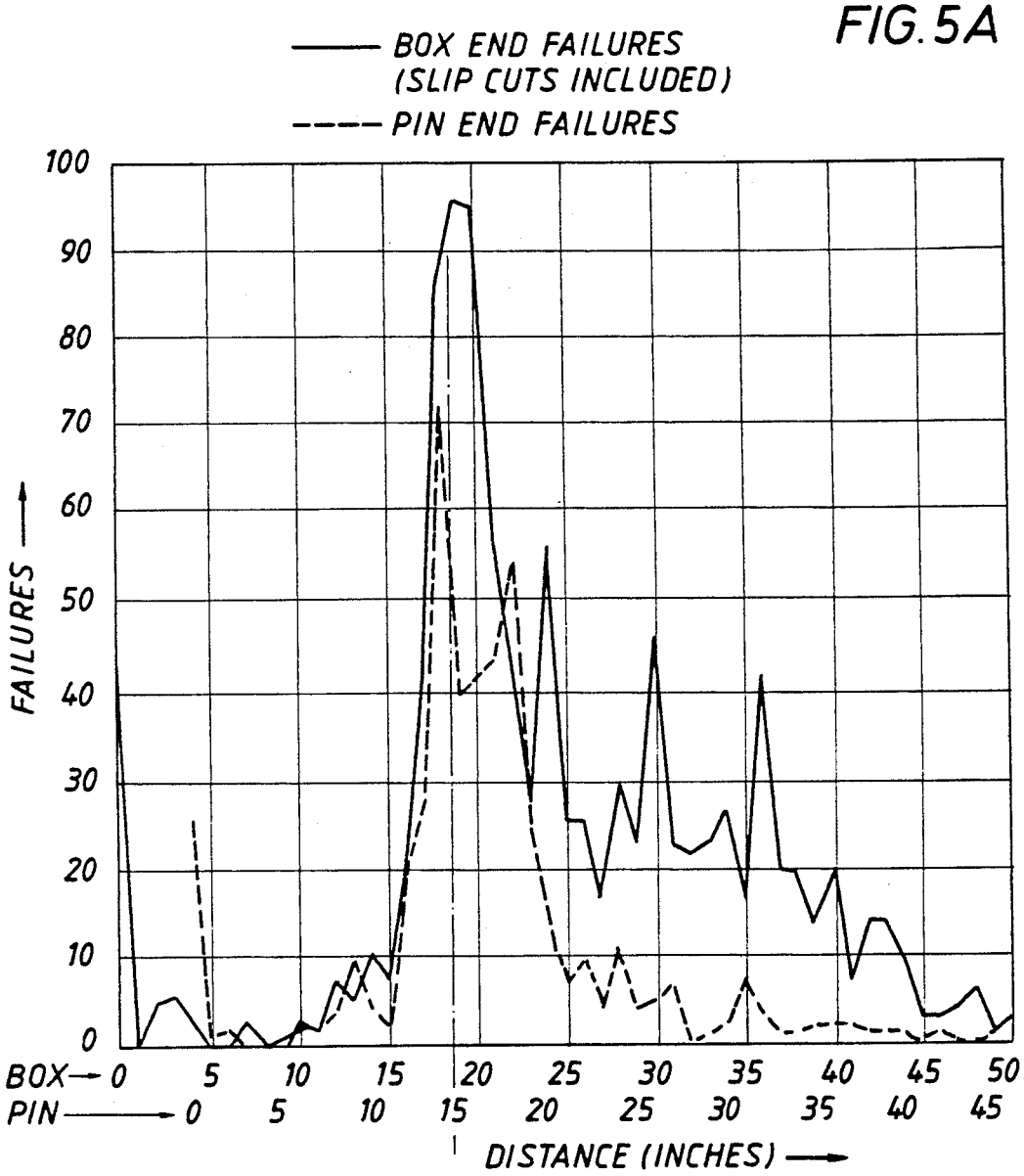
Figure 5B:
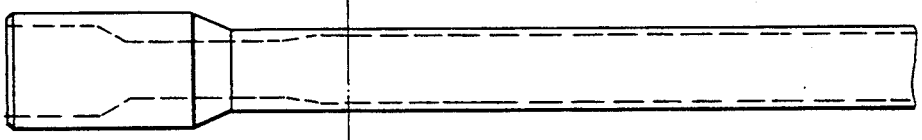
Figure 5C:
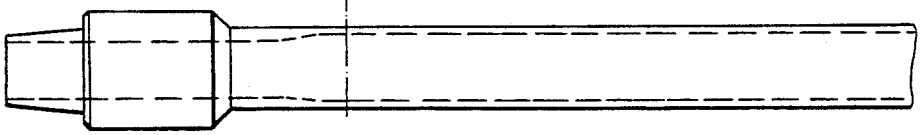

FIG. 5(A-C) graph showing where most drill pipe joint failures occur relative to the box end and the pin end of the joint.

Figure 6:
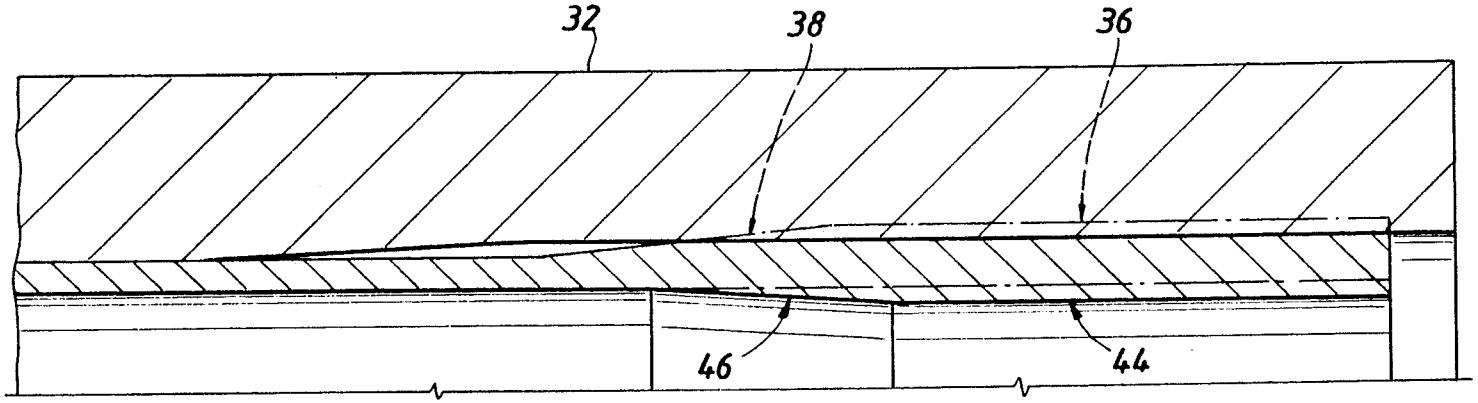

FIG. 6 is a sectional view on an enlarged scale showing the cross-sectional shape of the end of the tube before (in dashed lines) and after (solid lines) the third pressing pass or step.

Figure 7A:
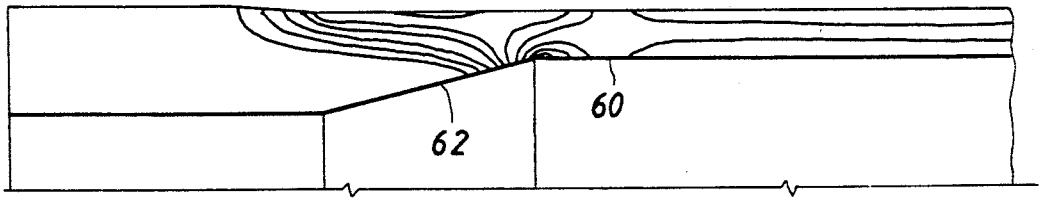
Figure 7B:
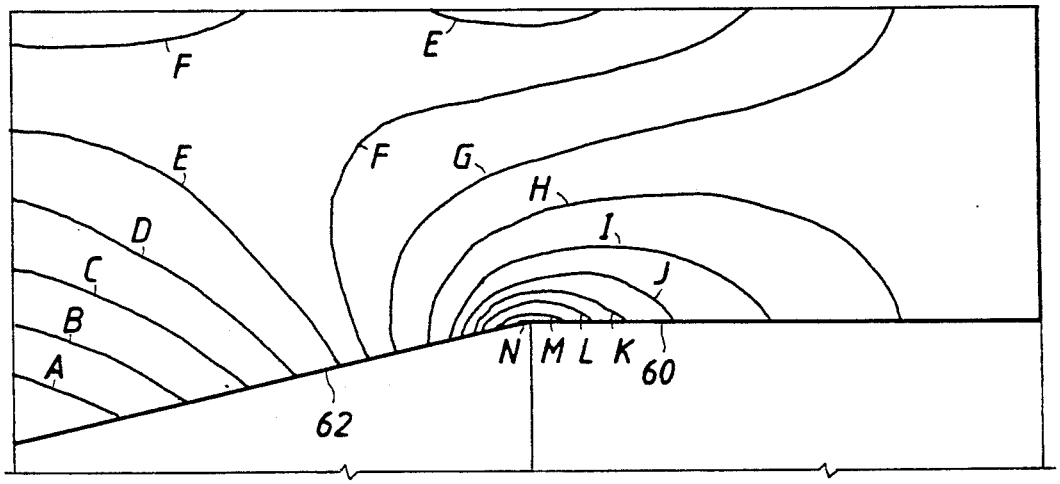

FIGS. 7A and 7B are computer produced stress plots of a 5" tube internally and externally upset with a radius of curvature between internal cylindrical surface 60 and conical surface 62 of 0.5" and an Miu length of 1.5".

Figure 8A:
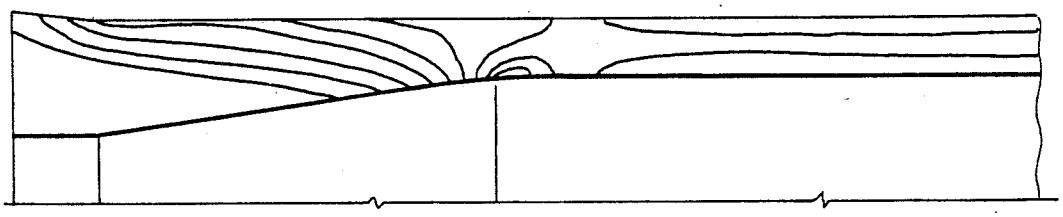
Figure 8B:
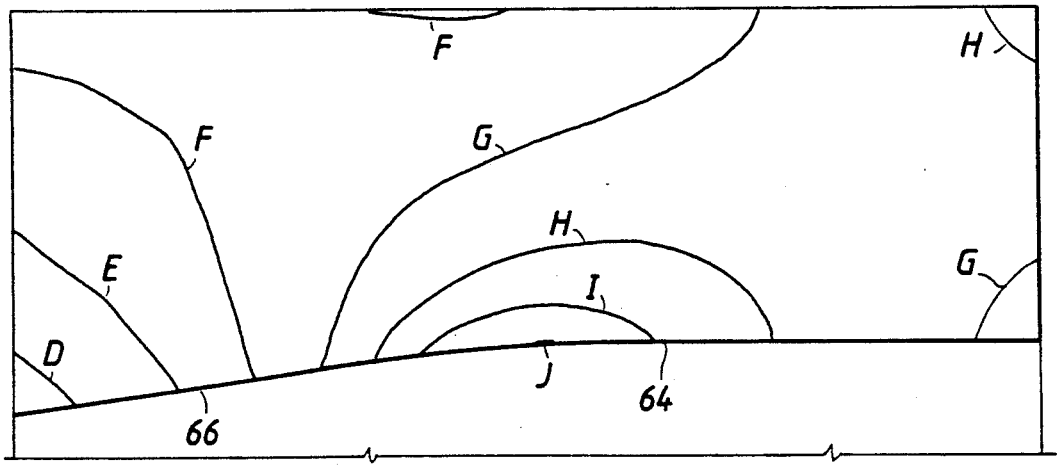

FIGS. 8A and 8B are computer produced stress plots of a 5" tube internally and externally upset with a radius of curvature between internal cylindrical surface 64 and conical surface 66 of 2.0" and a Miu of 2.5".

Figure 9A:
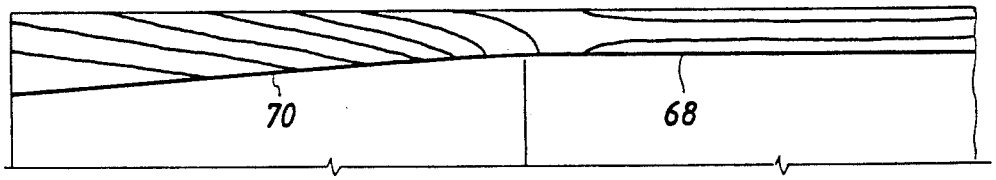
Figure 9B:
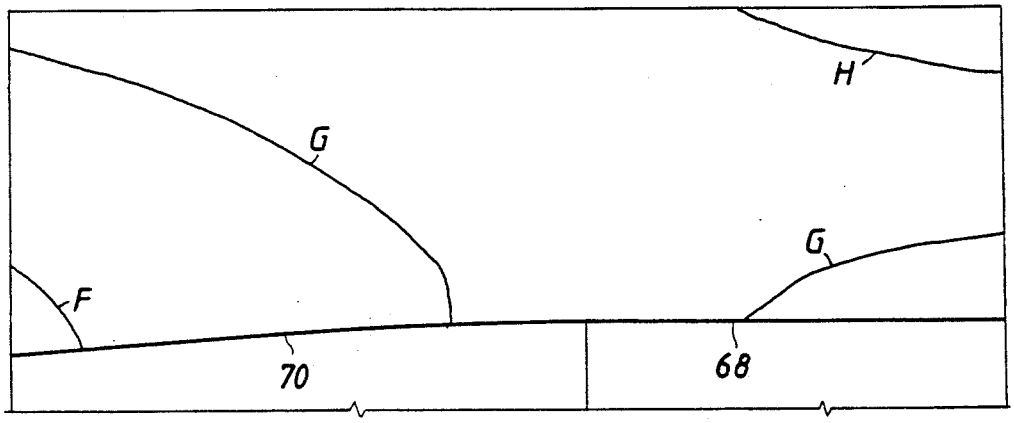

FIGS. 9A and 9B are computer produced stress plots of a 5" tube internally and externally upset using the method of this invention and having a radius of curvature between internal cylindrical surfaces 68 and conical surface 70 of 15" and a Miu of 6.75".

Figure 10:
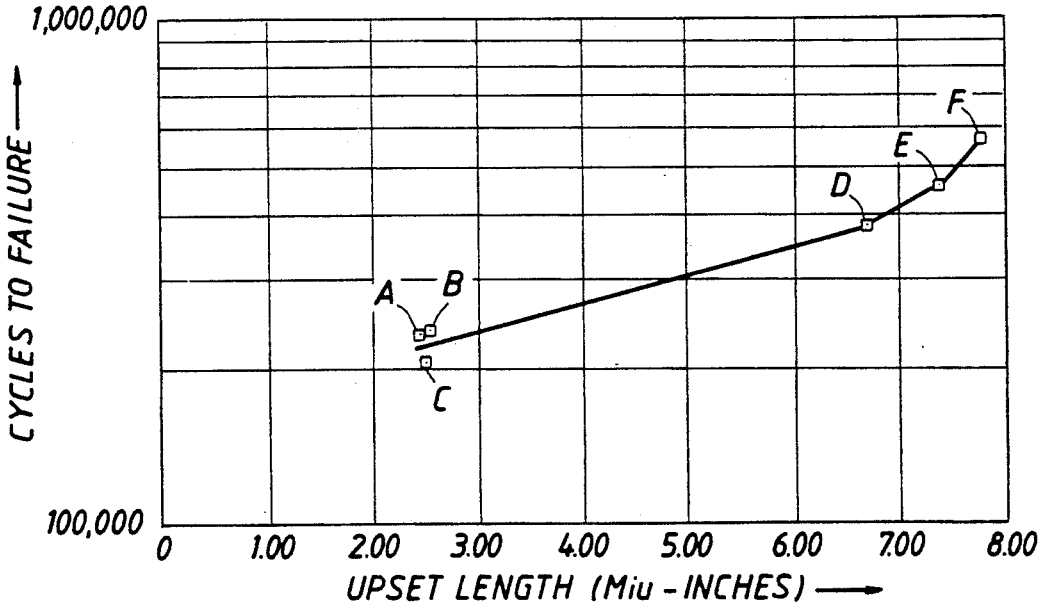

FIG. 10 is a graph showing the relationship of upset fatigue life vs upset length (Miu-inches).

The two methods disclosed in the prior art '972 patent are shown in FIG. 1. FIG. 1A is just a cross-section of the end of the tube to be upset. The first step of the first method described in the patent is shown in FIG. 1B where die 12 and mandrel 14 combine to force the metal adjacent the end of the tube outwardly to form cylindrical section 13 having a wall with the thickness A. Cylindrical section 13 is connected to the non-upset portion of tube 10 through conical transition section 16.

Figure 1A:
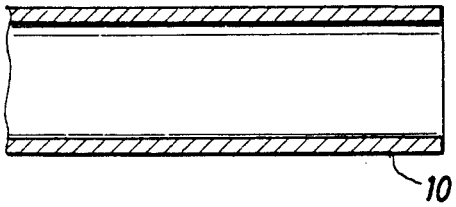
FIG. 1A (PRIOR ART)
Figure 1D:
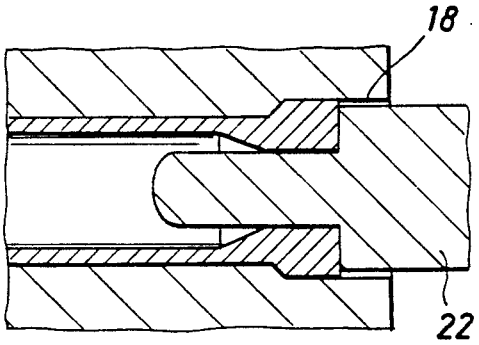
FIG. 1D (PRIOR ART)
Figure 1B:
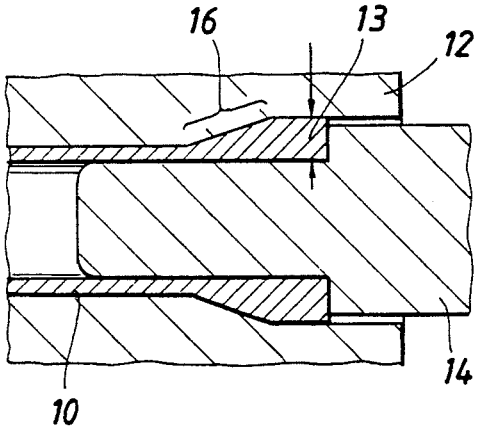
FIG. 1B (PRIOR ART)
Figure 1E:
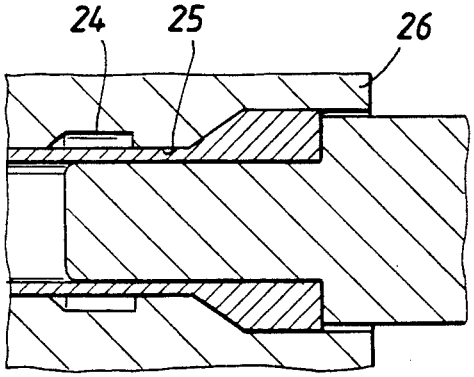
FIG. 1E (PRIOR ART)
Figure 1C:
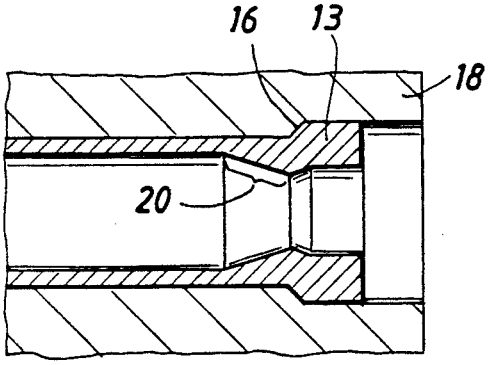
FIG. 1C (PRIOR ART)
Figure 1F:
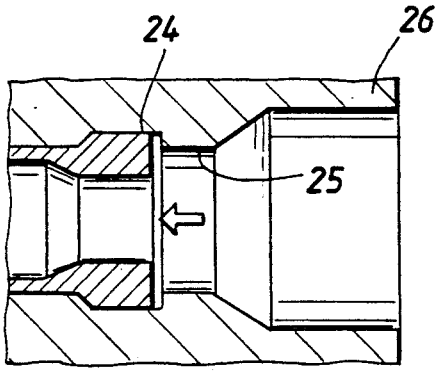
FIG. 1F (PRIOR ART)

The second step of the first method is shown in FIG. 1C. Here second die 18 is used to press a portion of the metal in conical transition section 16 and a portion of cylindrical section 13 inwardly to form conical section 20 on the inside of the tube that connects the portion of the metal of cylindrical section 13 that has been forced inwardly by die 18 to create an internal upset of the tube. The final step of the first method of the '972 patent is shown in FIG. 1D. The same die 18 is used and the final shape of the end of the tube is formed by die 18 and mandrel 22.

FIGS. 1E and F show an alternate process where the end of the tube is externally upset as shown in FIG. 1E. The patent says this is accomplished using die 18 as shown in FIGS. 1(C) and 1(D), but they don't look like the same die. In fact, die 26 shown in FIGS. 1(E) and 1(F) appear to be the same. In the second and final step the end of the tube is forced through restriction 25, after which it expands outwardly into groove 24.

Figure 2A:
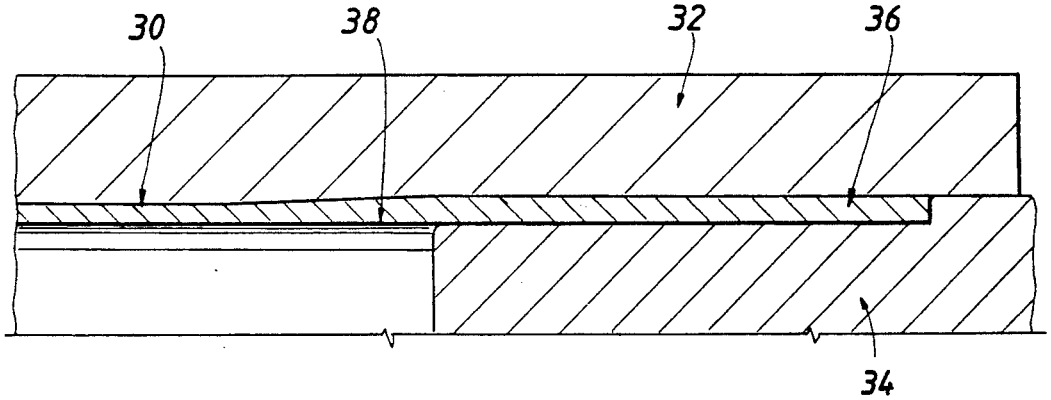
Figure 2B:
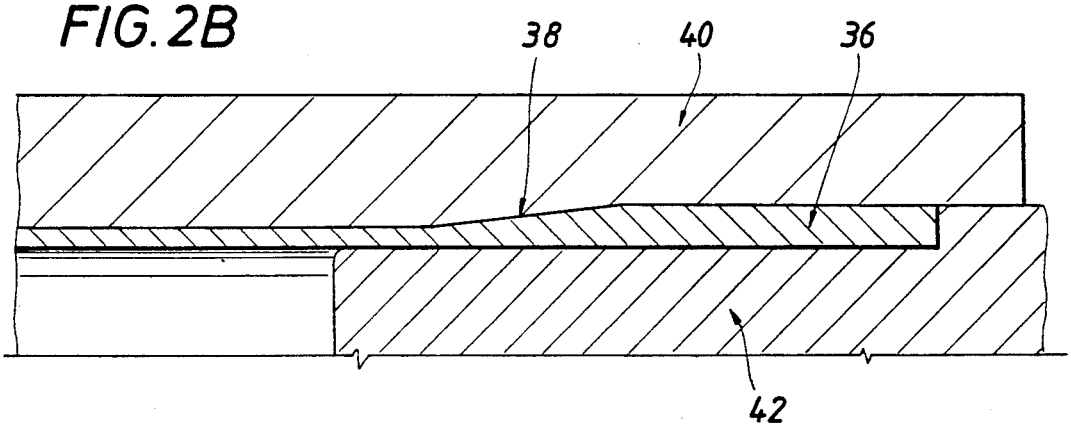

The method of this invention in shown in FIGS. 2A–D. FIG. 2A shows the first step of the method in which the end of tube 30 is externally upset using die 32 and mandrel 34. In this step, cylindrical section 36 of the tube wall adjacent the end of the tube is increased in thickness and conical section 38 is formed to provide the transition between cylindrical section 36 of increased diameter and the tube. In the second step shown in FIG. 2B, die 40 combines with mandrel 42 to increase the thickness of cylindrical section 36 which, of course, increases the angle of the taper of conical section 38.

Figure 2C:
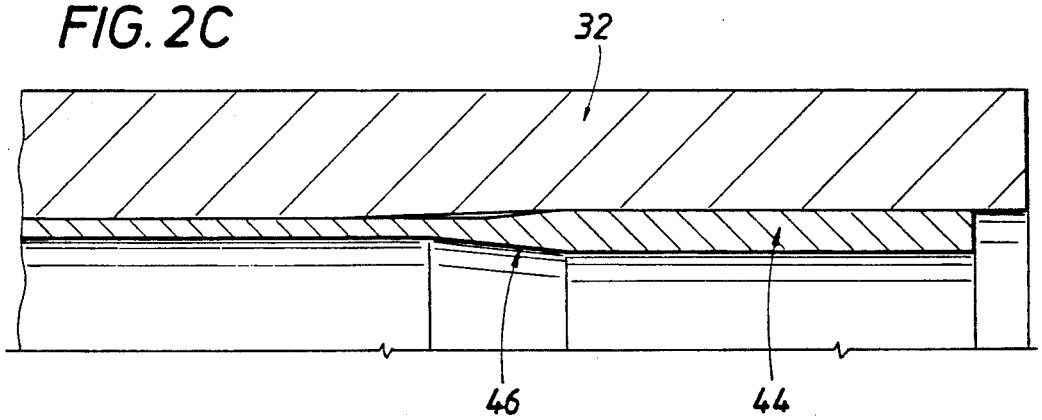

After the second step, the end of the tube is reheated to the original forging temperature (about 2200° F.) after which it is subjected to the third step of the process. As shown in FIG. 2C, die 32 (the same die that is used in the first step) is used alone in this step to press the metal inwardly that had been moved outwardly in steps 1 and 2. Before the die is closed, however, the tube is moved axially to the right to position cylindrical section 36 and conical section 38 in the cylindrical section of the die. This results in cylindrical section 44 having inside and outside diameters that are less than that of section 36 and a conical section 46 having a long tapered internal surface extending between the internal wall of cylindrical section 44 and the non-upset tube wall.

Figure 2D:
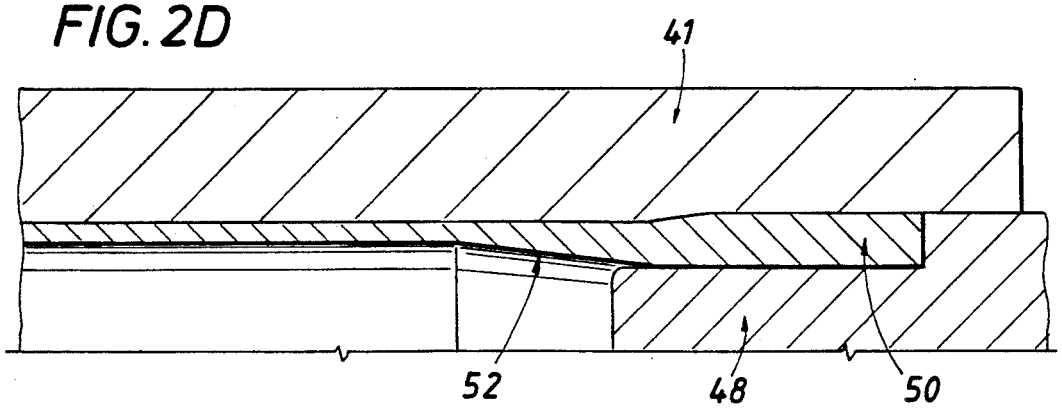

In the final and fourth step, shown in FIG. 2D, mandrel 48 combines with fourth step die 4 to shorten cylindrical section 44 thereby forming cylindrical section 50 having a thicker wall and smaller inside diameter and conical section 52 having a longer internal taper than conical section 46.

Figure 3:
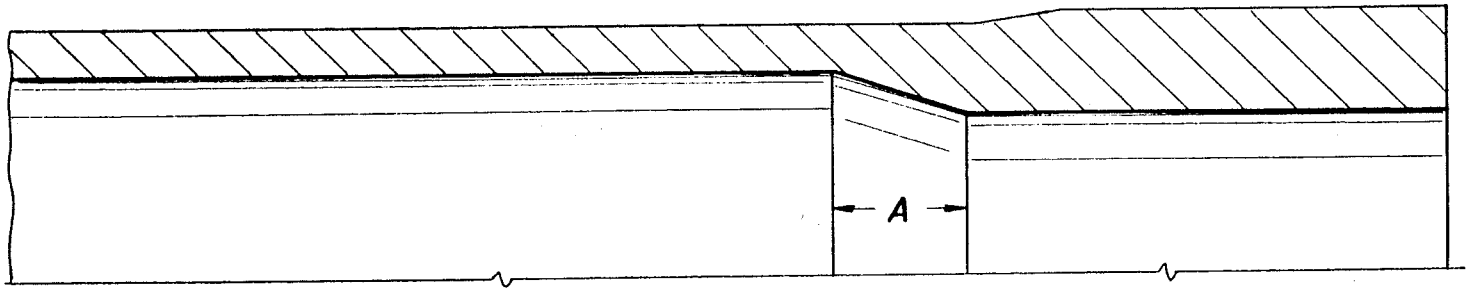
FIG. 3 is a cross-section of the end of a 5" diameter drill pipe tube internally and externally upset to the dimensions recommended by API.
Figure 4:
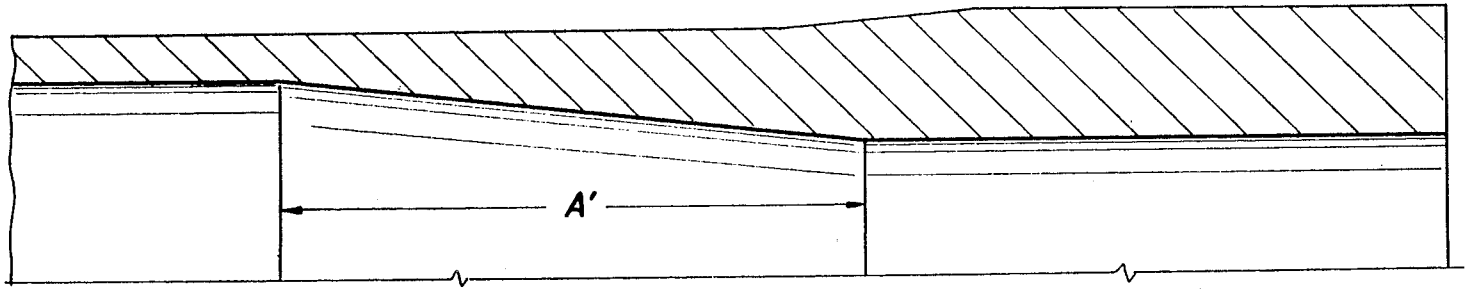
FIG. 4 is a cross-section of the end of a tube upset in accordance with the method of this invention.

The shape of the end result of the four steps just described is shown in FIG. 4 on a larger scale. The dimension shown both on FIG. 4 and the API joint of FIG. 3 are for 5", 19.5 lbs. per foot, drill pipe. Using Applicant's method of upsetting, the Miu dimension is shown as 4½", which is a minimum dimension. The average Miu length produced by the method of this invention is much greater. A random check of 5" tubes upset using the method of this invention, showed an average Miu length of 6.725" with a radius of curvature over 15". In fact, some of the 5" O.D. tubes had a radius of curvature up to 48".

It is believed that the longer Miu length results because two steps are used to initially upset the tube externally thereby gathering more metal for pressing inwardly in the third step, which step is further aided by again heating the metal to forging temperature. In FIG. 6, the shape of the end of the tube before and after the third pass or step for a 5", 19.5 lbs. per foot drill pipe is shown approximately to scale.

FIGS. 7A–9B show the stress patterns produced in three externally-internally upset joints of 5" diameter S-135 drill pipe. Each joint was rotated at 258 rpm while subjected to a lateral force 17" below the elevator taper on the tool joint that created a stress of 35,400 psi in the tube portion of the joint. A force of around 2,240 lbs. was required. The computer was programmed for the letter "O" to indicate stresses of 48,000 psi and above. Each preceding letter was programmed to indicate a stress reduction of 2,000 psi. Thus, "A" indicates a stress reduction of 20,000 psi, "B" a stress of 22,000 psi and so on.

FIG. 10 shows the cycles to failure for three API internal-external upset drill pipe joints and three external-internal upset drill pipe joints using the method of this invention. Joints A,B, and C are the former and D,E, and F the latter.

Joints A, B, and C failed after 237,618, 235,296, and 205,884 cycles, respectfully. Joint D had a Miu taper of 6 11/16". It failed after 382,666 cycles. Joint E had a taper of 7 3/8" and failed after 462,028 cycles. Joint F had a taper of 7¾ and failed after 569,664 cycles.

From the foregoing it will be seen that this invention is one well adapted to attain all of the ends and objects hereinabove set forth, together with other advantages which are obvious and which are inherent to the method.

What is claimed is:

1. A method of internally and externally upsetting the end of a metal tube comprising heating the section of the tube to be upset to forging temperature, upsetting the end of the metal tube to provide the end with an increased wall thickness and outside diameter using a first die having a first cylindrical section having an inside diameter substantially equal to the outside diameter of the tube, a second cylindrical section having an inside diameter equal to the increased diameter of the end of the tube and a tapered section connecting the two cylindrical sections and a first mandrel having a first cylindrical section with a diameter substantially equal to the inside diameter of the tube, a second cylindrical section having an outside diameter substantially equal to the inside diameter of the second cylindrical section of the die, and a shoulder between the two sections of the mandrel to engage the end of the tube and force the metal adjacent the end of the tube into engagement with the die, further upsetting the end of the metal tube to provide the end with an increased wall thickness and outside diameter using a second die having a first cylindrical section having an inside diameter substantially equal to the outside diameter of the tube, a second cylindrical section equal to the further increased diameter of the end of the tube and a tapered section connecting the two cylindrical sections and a second mandrel having a first cylindrical section with a diameter substantially equal to the inside diameter of the tube, a second cylindrical section with an outside diameter substantially equal to the inside diameter of the second cylindrical section of the second die, and a shoulder connecting the first and second sections to engage the end of the tube and force the metal adjacent the end of the tube into engagement with the internal surface of the second die, reheating the end of the tube to forging temperature, radially pressing the upset end of the tube inwardly with the first die to reduce the outside diameter of the end and form a taper on the inner surface of the tube, and upsetting the end to thicken the wall thickness and increase the length of the inside taper while reducing the outside diameter using a third die and a third mandrel having a first cylindrical section of reduced diameter to allow the thickness of the tube to be increased and the inside taper lengthened without increasing the outside diameter of the upset, a second cylindrical section having a diameter equal to the diameter of the second cylindrical section of the third die, and a shoulder connecting the two sections for shortening the length of the upset, increasing the wall thickness, and lengthening the inside taper as the mandrel is moved against the end surface of the upset end of the tube.

2. The method of claim 1 in which the upset end of the tube is positioned completely within the second cylindrical section of the die prior to the pressing step.

3. A method of internally and externally upsetting the end of a metal tube comprising heating the section of the tube to be upset to forging temperature, upsetting the end of the metal tube to provide the end with an increased wall thickness and outside diameter using a first die having a first cylindrical section having an inside diameter substantially equal to the outside diameter of the tube, a second cylindrical section having an inside diameter equal to the increased diameter of the end of the tube and a tapered section connecting the two cylindrical sections and a first mandrel having a first cylindrical section with a diameter substantially equal to the inside diameter of the tube, a second cylindrical section having an outside diameter substantially equal to the inside diameter of the second cylindrical section of the first die, and a shoulder between the two sections of the mandrel to engage the end of the tube and force the metal adjacent the end of the tube into engagement with the die to form the tube into a cylindrical section of increased wall thickness, an outside diameter and a tapered section connecting the cylindrical section to the tube, further upsetting the end of the metal tube to provide the end with a cylindrical section of increased wall thickness and outside diameter and a tapered section connecting the cylindrical section to the tube using a second die having a first cylindrical section having an inside diameter substantially equal to the outside diameter of the tube, a second cylindrical section having a diameter equal to the further increased diameter of the cylindrical section of the tube, and a tapered section connecting the two cylindrical sections of the die and a mandrel having a first cylindrical section with a diameter substantially equal to the inside diameter of the tube, a second cylindrical section with an outside diameter substantially equal to the inside diameter of the second cylindrical section of the second die, and a shoulder connecting the first and second sections to engage the end of the tube and force the metal adjacent the end of the tube into engagement with the internal surface of the second die, reheating the end of the tube to forging temperature, positioning the tube in the first die with the cylindrical and tapered sections of the tube positioned in the cylindrical section of the first die and radially pressing the upset end of the tube inwardly with the first die to reduce the outside diameter of the cylindrical section of the tube and to form a taper on the inner surface of the tube, and upsetting the end to thicken the wall thickness and increase the length of the inside taper while reducing the outside diameter using a third die and a third mandrel having a first cylindrical section of reduced diameter to allow the thickness of the tube to be increased and the inside taper lengthened without increasing the outside diameter of the upset, a second cylindrical section having a diameter equal to the diameter of the second cylindrical section of the third die, and a shoulder connecting the two sections for shortening the length of the upset, increasing the wall thickness, and lengthening the inside taper as the mandrel is moved against the end surface of the upset end of the tube.

* * * * *